United States Patent [19]

Hiromoto et al.

[11] Patent Number: 4,610,150

[45] Date of Patent: Sep. 9, 1986

[54] KNITTED FABRIC, METHOD OF KNITTING SAME AND MACHINE FOR THE SAME

[76] Inventors: Takenori Hiromoto; Yoshito Hiromoto; Takuji Hiromoto, all of 747-1, Yoshihara, Wakayama, Japan

[21] Appl. No.: 820,700

[22] Filed: Jan. 21, 1986

Related U.S. Application Data

[62] Division of Ser. No. 778,527, Sep. 20, 1985, Pat. No. 4,587,811.

[51] Int. Cl.[4] ..... D04B 15/00

[52] U.S. Cl. ..... 66/115

[58] Field of Search ..... 66/115, 114, 19, 24

[56] References Cited

U.S. PATENT DOCUMENTS 3,167,939 2/1965 Imon ..... 66/115 X

*Primary Examiner*—Ronald Feldbaum

*Attorney, Agent, or Firm*—Koda and Androlia

[57] ABSTRACT

A knitted fabric provided with piles formed between the face and back side structures which are stitched to each other. The knitted fabric is manufactured by a way of knitting a bulky knitted fabric while forming piles and using a pile forming yarn doubled with one or both of a face structure forming foundation yarn and a back structure forming yarn between wales at which these yarns are all stitched together. The knitting is accomplished using a knitting machine wherein needle beds for pile forming needles different from and adjacent to those for forming the foundation structure are provided on one or both of a dial and a cylinder side of the machine so that pile forming needles may project or withdraw to form piles while the foundation structure is knitted.

1 Claim, 5 Drawing Figures

KNITTED FABRIC, METHOD OF KNITTING SAME AND MACHINE FOR THE SAME

This is a division of application Ser. No. 778,527, filed Sept. 20, 1985 now U.S. Pat. No. 4,587,811.

BACKGROUND OF THE INVENTION

1. FIELD OF THE INVENTION

This invention relates to a knitted fabric composed of loops in a course each stitched to one of the loops in the adjoining course after another, to a method of knitting a fabric as described above, and to a machine used for embodying the above method.

2. PRIOR ART

The so-called tubular plain stitch fabric knitted by a knitting machine in such a way that needles in the front needle bed are independently operated from those in the rear needle bed and knitting yarns in groups different from each other are fed through yarn passages disposed front and rear to be stitched by a suitable method at several points required for preventing the face and back side structures from being separated from each other, or the pile stitch fabric knitted from two lines of knitting yarns, one of which being knitted into a plain stitch fabric for providing back side piles is widely known. The simple tubular plain stitch, however, cannot provide sufficient bulkiness, and the ordinary pile stitch is followed by a drawback that piles tend to be caught and drawn out by something protruding.

The conventional knitting machine in which two kinds of needles operate in a common needle bed has not been perfected because the pile forming needle, when moving forward, touches the foundation forming yarn obstructively to knitting operation.

SUMMARY OF THE INVENTION

An object of this invention is to provide a knitted fabric which is soft, bulky, and excellent in warmth-keeping and moisture-absorbing properties.

Another object of this invention is to provide a knitted fabric which is suitably used for not only underwear and outerwear but also winter clothes and sports socks.

Still another object of this invention is to provide a method of efficient knitting which permits pile formation in the fabric to be performed at the same time as the formation of the foundation structure.

A further object of this invention is to provide a knitting machine which enable smooth operation of two kinds of needles in one needle groove without obstructing knitting operation and also without producing a cause of defects.

DETAILED DESCRIPTION OF THE INVENTION

Figure 1:
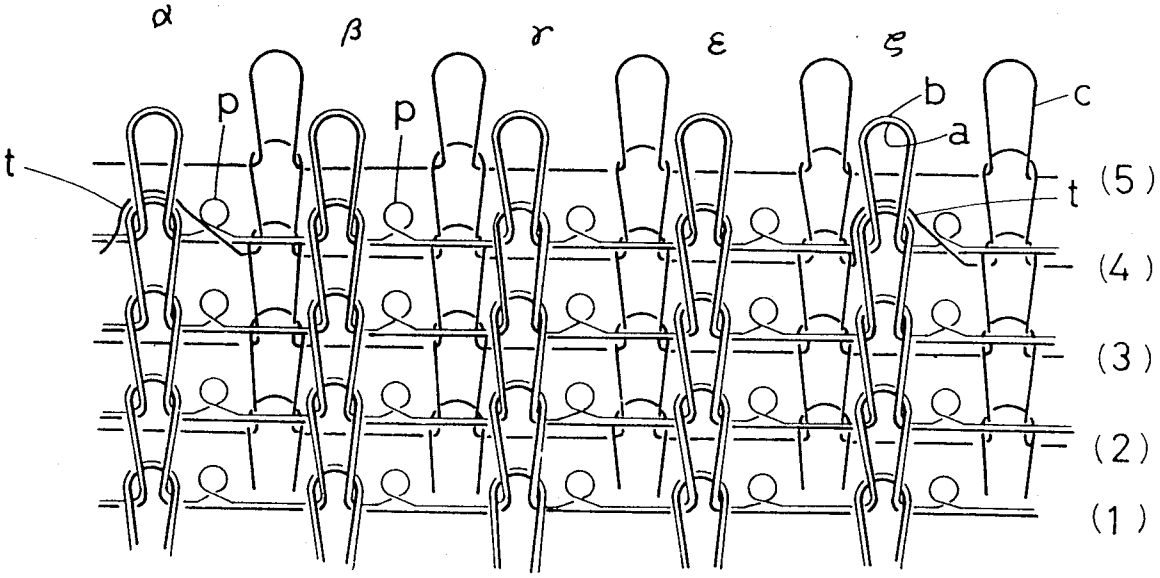
FIG. 1 is a view of an embodient of this invention, showing the structure of a knitted fabric.
Figure 2:
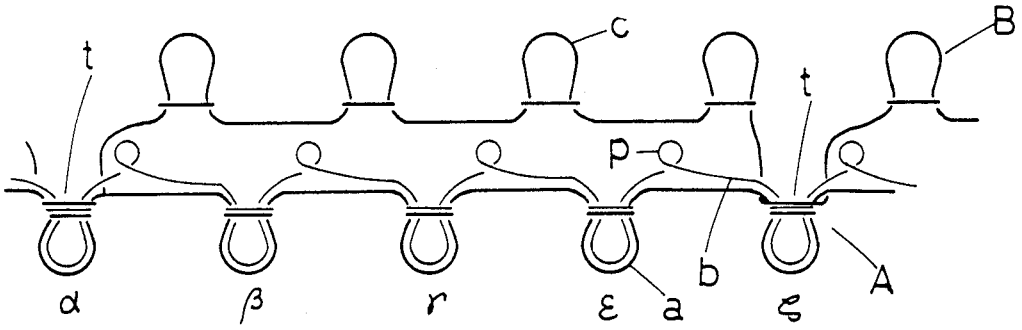
FIG. 2 is a sectional view of the knitted fabric taken from a course (4) thereof.
Figure 3:
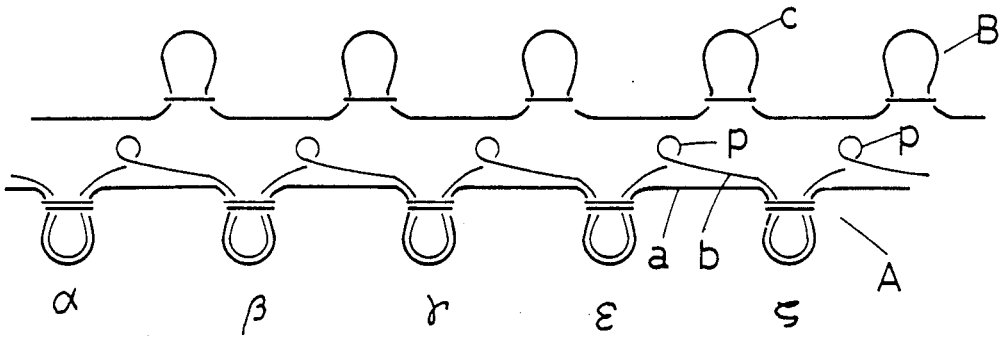
FIG. 3 is a sectional view thereof taken from a course (2)
Figure 4:
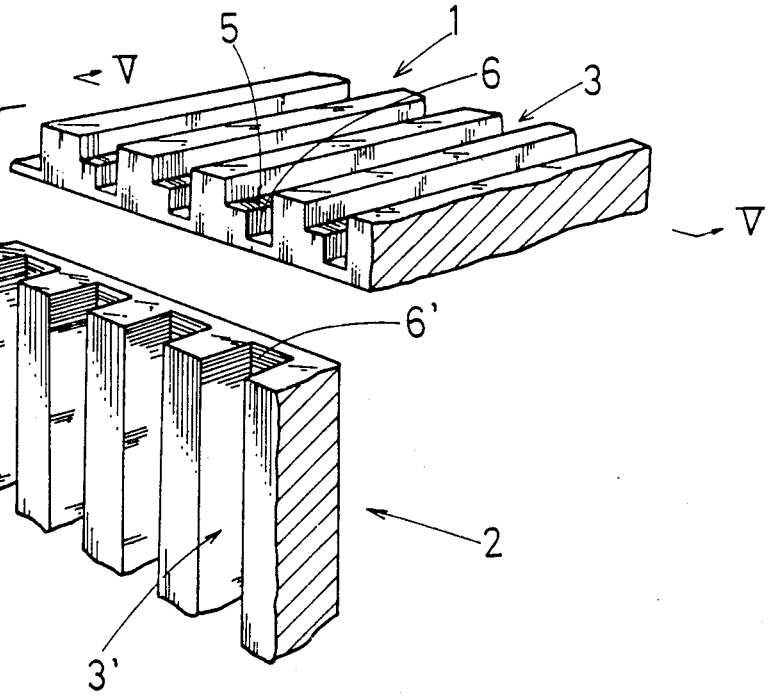
FIG. 4 is a perspective view of the main part of a knitting machine according to this invention.

FIGS. 1 through 3 are views of the structure of a fabric as an embodiment of this invention, wherein sinker piles p are formed between the face side plain stitch structure A and the back side one B (Refer to FIG. 2); and, in more detail, in the face side plain stitch structure, needle loops are formed of foundation forming yarns a and pile forming yarns b to provide courses (1), (2), (3), and (4), and pile forming yarns b further form sinker piles p between wales $\alpha$, $\beta$, $\gamma$, $\epsilon$, and $\zeta$ in turn.

In the back side plain stitch structure B, foundation yarns c are formed into needle loops to compose courses (1), (2), (3), (4), and (5). The face side plain stitch structure A is stitched to the back side one B with the tuck stitches t using the foundation forming yarn c at the course (4) as one of every four courses and at wales $\alpha$ and $\zeta$ each being one of every four wales on the face side.

A knitted fabric according to this invention is not limited to the above embodiment in structure and may be composed of other stitches than the plain one, and pile forming yarns can be used for the back side plain stitch structure B or for both the face side one A and the back side one B so that piles may project from the back side or from both side, respectively.

Further, the number of stitches, in other words, positions of tuck stitches, to connect the face side plain stitch structure A to the back side one B is optional according to the use of the fabric and not limited to that applied to the above embodiment having one stitch at an intersection of one of every four courses and one of every four wales.

As apparent from the foregoing, a tubular plain stitch knitted fabric of this invention having the face side and back side structures stitched to each other, in which any one or both of the face side and back side structures is composed of pile stitches and piles are interposed between the face and back sides, is soft and more bulky than conventional plain stitch fabrics or knitting quiltings to which inlay stitches are applied, as well as excellent in warmth-keeping and moisture-absorbing properties.

Since no piles emerge on the face side of the knitted fabric, the knitted fabric is free from drawbacks such as the piles getting caught and drawn out by projections which is caused in conventional pile stitch knitted fabric.

A method of knitting the above fabric is described below.

A face side plain stitch structure A is constructed in such steps that, when courses (1), (2), (3), (4), and (5) are formed of the foundation forming yarn c, needle loops are formed of the pile forming yarn b similarly to the other needle loops of the foundation forming yarn a, and sinker piles p are formed between wales $\alpha$, $\beta$, $\gamma$, $\epsilon$, and $\zeta$ in turn; and, at the same time, a back side plain stitch structure B is constructed by forming courses (1), (2), (3), (4), and (5) with the foundation forming yarn c, the back side structure being stitched to the face side one with tuck stitches t at wales $\alpha$ and $\zeta$ during the progress of the above steps of course formation.

In this way, a knitted fabric is obtained which is in the form of a tube composed of plain stitches having the face side plain stitch structure A and the back side B stitched to each other and a multiple of pile p formed between both structures at the same time as stitching of both structures.

A knitting method according to this invention has been described with reference to the above embodiment, however, this invention is not limited to this embodiment and the position of the tuck stitches may optionally be changed and various types of materials may selectively be used for the yarns according to the purpose or use of the fabric to be knitted.

According to the knitting method of this invention, knitting of the face side plain stitch structure A and the back side B, formation of piles, and tuck stitching are simultaneously performed and, therefore, a knitted fabric which is soft, bulky, and excellent in warmth-keeping and moisture-absobing can be produced at greatly high efficiency as compared with a method of stitching two separate sheets of one-side-pile fabrics to each other with pile surfaces of the two disposed face to face.

A detailed description of a knitting machine according to the present invention will be given as follows.

Figure 5:
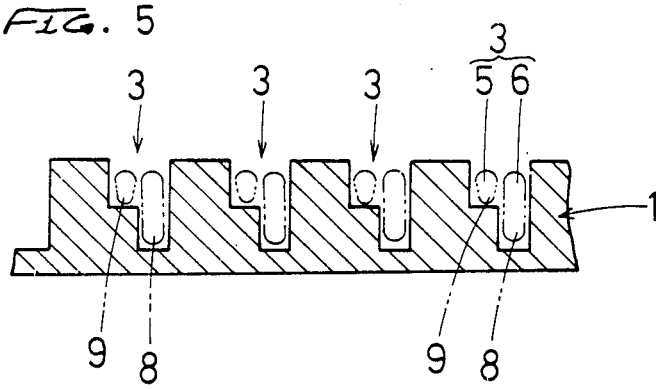
FIG. 5 is a partially sectional view taken along the line V—V in FIG. 4.

The knitting machine of this invention is characterized by a structure modified from a knitting machine generally used and provided with a cylinder and dial, in which latch-less needles, sinker needles, and presser needles for pile formation and needle grooves for independent operation of these needles are provided on one or both of the dial and the cylinder in such a manner that these needles for pile formation are disposed adjacently to latch needles arranged for knitting the foundation structure, a description thereof being made with reference to the drawings as follows:

The drawings are partial perspective views of needle beds on the dial side 1 and the cylinder side 2 and a sectional view taken along the line V—V in one of the above perspective views, wherein the needle groove 3 on the dial side 1 comprises a needle bed 6 for foundation formation to guide the foundation forming needle 8 (Refer to FIG. 5) and another needle bed 5 for the pile forming needle which is shallower than the bed 6, with an opening part common to these two needle beds, the foundation forming needle 8 and the pile forming needle 9 being disposed on the foundation forming needle bed 6 and the pile forming needle bed 5 (Refer to FIG. 5), respectively.

The needle bed 3' on the cylinder side 2 contains only a foundation forming needle bed 6' for receiving only the foundation forming needle.

In the above-described knitting machine as an embodiment of this invention in which needle beds on the dial side and those on the cylinder side are used for knitting the face side plain stitch structure A and the back side B, respectively, and piles are formed between these two structures while the face side plain stitch structure A is knitted by the use of pile forming needles, a pile forming needle bed formed one step higher than the foundation forming needle bed adapts the pile foming needle to operate in a position one step higher than that of the foundation forming needle, whereby the yarn for foundation forming to be threaded on the foundation forming needle is prevented from moving by the side wall of the stepped part and detached from the operation range of the pile forming needle. Therefore, the pile forming needle is prevented from touching the foundation forming yarn and enables exceedingly smooth knitting of the fabric of this invention.

A foundation forming needle bed and a pile forming needle bed are provided in the needle groove on the dial side in the case of this embodiment and on the cylinder side when piles are intended to be formed on both the face side plain stitch structure A and the back side one B.

Thus, a simple structure of the knitting machine of this invention obtained by modifying only a part of the conventional knitting machine having needle beds on the dial side and the cylinder side prevents knitting operation from being obstructed by pile forming needles which touch the foundation forming yarn threaded on the foundation forming latch needles during the forward movement thereof, thereby preventing possible defects in the knitted fabric.

We claim:

1. A knitting machine in which needle beds are disposed on the dial side and cylilnder side, characterized by being fabricated into a structure wherein a needle groove on one or both of the dial and cylinder sides contains a foundation forming needle bed for guiding the foundation forming needle and a pile forming needle bed shallower than said foundation forming needle, both beds having a common opening part, wherein foundation forming needles and pile forming needles are disposed in said foundation forming needle bed and pile forming needle bed, respectively.

* * * * *